US005711330A

United States Patent [19]

Nelson

[11] Patent Number: 5,711,330

[45] Date of Patent: Jan. 27, 1998

[54] GOLF BALL WASHER WITH INTEGRAL AGITATOR

[75] Inventor: Donald C. Nelson, Medina, Ohio

[73] Assignee: S.G.D. Co., Inc., Medina, Ohio

[21] Appl. No.: 514,323

[22] Filed: Aug. 11, 1995

[51] Int. Cl.[6] ..... B08B 1/04

[52] U.S. Cl. ..... 134/133; 133/134; 15/21.2

[58] Field of Search ..... 134/61, 66, 133, 134/134; 15/3.15, 3.14, 21.2

[56] References Cited

U.S. PATENT DOCUMENTS

| | | | |
|---|---|---|---|
| 987,943 | 3/1911 | Beck et al. | 15/3.15 |
| 1,157,017 | 10/1915 | Lowe | 134/134 |
| 2,931,058 | 4/1960 | Knudsen | 15/21.2 |
| 3,083,389 | 4/1963 | Wittek | 15/21.2 |
| 3,120,669 | 2/1964 | Montuori | 15/21.1 |
| 3,156,248 | 11/1964 | Rand | 134/134 |
| 3,604,435 | 9/1971 | Day, Jr. et al. | 134/134 |
| 3,733,633 | 5/1973 | Gustafson | 15/21.2 |
| 4,773,114 | 9/1988 | Thrasher | 15/21.2 |
| 4,805,251 | 2/1989 | Hollrock | 15/21.2 |
| 5,139,577 | 8/1992 | Brock | 15/21.1 |

*Primary Examiner*—Frankie L. Stinson

*Attorney, Agent, or Firm*—Renner, Kenner, Greive, Bobak, Taylor & Weber

[57] ABSTRACT

An automated golf ball washer is provided with an integral agitation ball delivery means that is driven from the same power source that performs the golf ball cleaning function. The shaft that drives the washing mechanism has a cam thereon, that drives a reciprocating rod into the box holding the golf balls to be washed. The reciprocating action of the rod forces any balls jammed in the box to become dislodged, thereby encouraging a continuous feed of golf balls to the washing device.

18 Claims, 2 Drawing Sheets

GOLF BALL WASHER WITH INTEGRAL AGITATOR

TECHNICAL FIELD

The invention herein resides in the art of powered washing devices and, more particularly, to automated golf ball washing machines. Specifically, the invention relates to an automated powered golf ball washer in which the tray holding the golf balls to be washed is shaken or agitated by the same motor that drives the cleaning brush.

BACKGROUND ART

The game of golf has become tremendously popular. Both actual play upon a golf course and practice such as at putting greens and driving ranges have become routine pastimes for a large percentage of the populace. At driving ranges, thousands of balls are handled daily. It is, of course, extremely important that such balls be kept clean to assure a true trajectory of the balls and to maintain an appearance which is generally appealing to the public. Such is, of course, true of any golf play.

On golf courses, manually operated hand washers are sufficient to clean the balls between play. In such devices, a slide having an aperture therein is manually moved between brushes, with the golf ball retained within the aperture. Such activity is typically sufficient to assure that the ball is clean when play is resumed. At driving ranges, however, thousands of balls are driven and collected daily, requiring an automated cleaning method. Typical of known automated golf ball washers is that taught in the prior art by U.S. Pat. No. 4,805,251 in which arcuate or spiral paths are provided to pass the balls from an input to an output, such balls being driven along the arcuate path by means of a rotating brush which also serves to clean the balls during transport. Typically, such a brush is connected to a motor which is actuated and deactuated by means of a switch. The brush is maintained upon a shaft which is secured at each end by fixed bearings or fixed journals that entirely circumferentially secure the shaft.

In the prior art, automated ball washers required the use of large holding trays to store the golf balls while the golf balls were being delivered to the washing apparatus. Due to the large number of balls being deposited into the holding tray, the balls would often become jammed in the area of delivery to the washing apparatus. In such instances, the balls would actually bridge the opening feeding from the tray to the spiral path of the working apparatus. Jams could also be caused by mud or grass clinging to the balls to be washed or by other foreign matter that was picked up with the balls to be cleaned. To alleviate the jams, an operator would be required to slowly hand deliver the golf balls to the holding tray in an attempt to prevent a jam from occurring or by manually stirring the golf balls to break up the jam. Both of these methods require constant operator supervision, thereby defeating one of the purposes of having an automated golf ball washer.

To solve the problem of constant operator supervision, the prior art has taught the use of a vibratory means to continually vibrate the golf ball holding tray, thereby preventing or unclogging any jams that may occur. Specifically, the prior art taught the use of a vibratory motor interconnected to the tray, the sole purpose of the motor being to shake loose any jams in the golf ball holding tray and to prevent such jams from occurring. The vibratory motor was typically attached directly to the holding tray or mechanically linked thereto. Desirably, the motor's vibratory motions were directed to the area of the tray where jams were most likely to occur. In the past, means for effecting the desired vibratory activity from the dedicated motor included shaking the entire holding tray, rotating belts located within the tray to stir and thereby loosen any jammed golf balls, and rotating beaters which also served to loosen and stir any jammed golf balls.

Although these prior art systems have proven to be somewhat effective, it has been found that utilization of the prior art golf ball cleaning systems has required constant operator supervision or the inefficient use of two motors (one to wash the golf balls, the second to deliver the balls to the cleaning system). Accordingly, there is a need in the art for an automated golf ball washer for use at a golfing range, which allows for minimal supervision, a simplification of the required equipment, and efficient use of energy. Additionally, the automated golf ball washer must be effective in preventing jams of golf balls that are to be delivered to the washing machine.

DISCLOSURE OF INVENTION

In light of the foregoing, it is a first aspect of the invention to provide a golf ball washer that has an integral agitator to prevent golf balls from jamming in a holding tray before they are delivered to the washing apparatus.

An additional aspect of the invention is to provide an automated golf ball washer that is energy efficient by using the motor that powers the cleaning of the golf balls to also power the means that prevents golf balls from jamming in a holding tray.

Another aspect of the invention is the provision of a golf ball washer having an integral agitator which is of simplified construction with respect to the prior art, employing a single motor to perform both the washing and agitation functions.

Still a further aspect of the invention is to provide an automated golf ball washer having an agitator that can be easily disengaged from the motor so that the washer can be serviced as needed.

Yet an additional aspect of the invention is to provide an automated golf ball washer with an integral agitator that is reliable and durable in operation, that requires minimal supervision during operation, and that is inexpensive to construct and maintain.

The foregoing and other aspects of the invention which will become apparent as the detailed description proceeds are achieved by a golf ball washer, comprising: a washing device; a shaft connected to said washing device at a first end thereof; a motor connected to a second end of said shaft for rotatably driving said shaft; a golf ball holding box receiving a plurality of golf balls and feeding the golf balls to said washing device; and agitation means interposed between said shaft and said holding box for agitating said holding box to assure passage of the golf balls from the holding box to the washing device.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
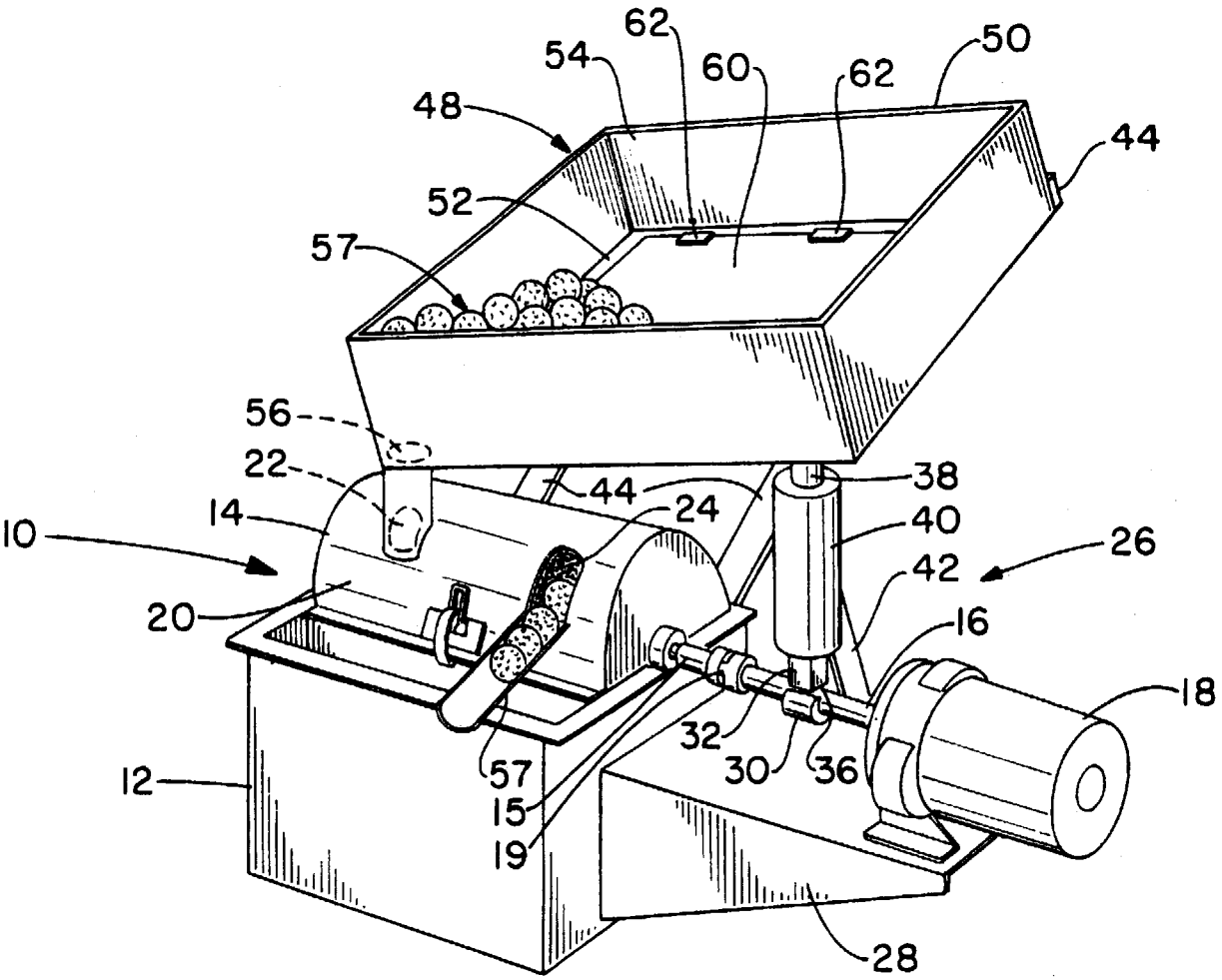
FIG. 1 is a perspective view of an automated golf bail washer with an integral agitator according to the invention.

Referring now to the drawings and more particularly to FIG. 1, it can be seen that a golf ball washer according to the invention is designated generally by the numeral 10. The ball washer 10 includes a tank housing 12 with a washing mechanism 14 for cleaning golf balls therein. A brush shaft 15 extends outwardly from the washing mechanism 14. The washing mechanism 14 is driven by a motor shaft 16, which is operatively driven by a motor 18. A removable coupling 19 selectively interconnects the motor shaft 16 to the brush shaft 15. The washing mechanism 14 has a cover 20 with a ball entry hole 22 wherein golf balls to be cleaned are entered and a ball exit chute 24 from which the clean golf balls are ejected after being exposed to the cleaning process. Connected to a side of the tank 12 and extending therefrom is a motor support 28 which is provided for purposes of receiving and supporting the motor 18.

Figure 2:
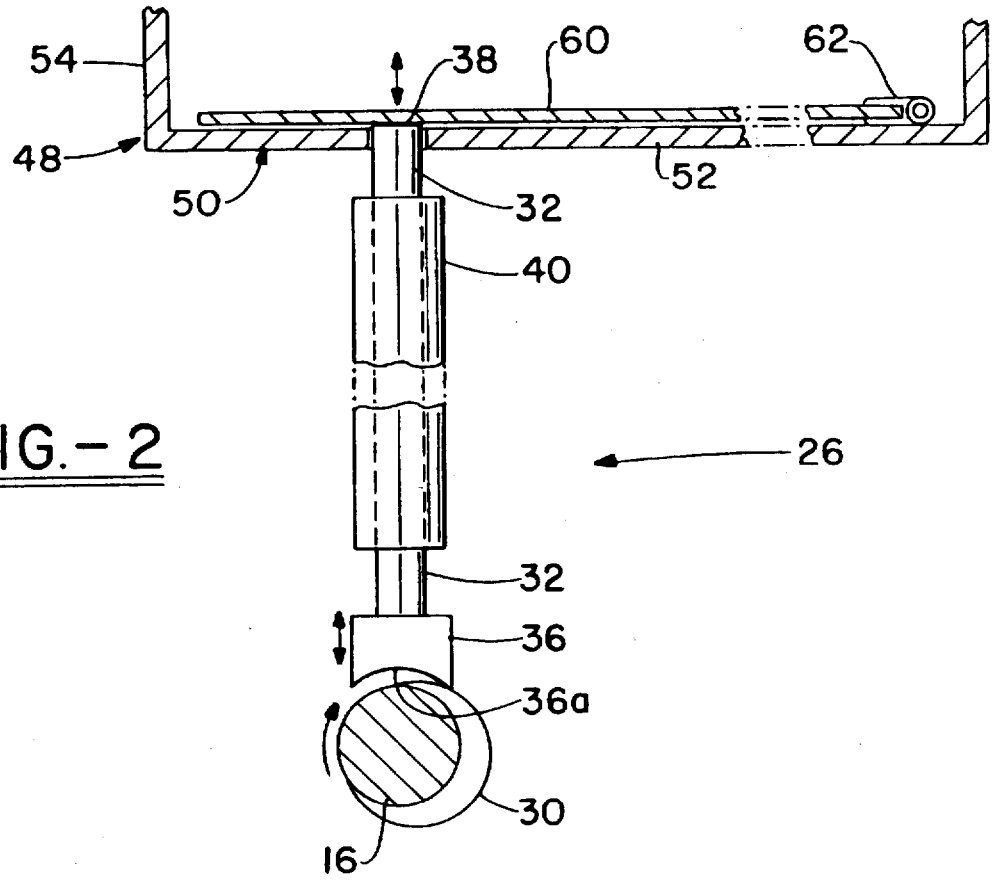
FIG. 2 is a vertical elevational view, in partial cross-section, through the motor drive shaft at the position of the agitator means of the invention.

As shown in detail in FIG. 2, an agitator means 26 is associated with the motor shaft 16 which includes a cam 30 as an integral part thereof. It should be appreciated that the cam 30 could be integral with the brush shaft 15. The motor shaft 16 supportingly receives an end of a rod 32 upon a circumferential area which includes the cam 30. The rod 32 has a cam end 36 with a bearing surface **36*a*, which is directly opposite a driving end 38. The driving end 38 may have a pad or foot integral therewith to assist the reciprocating motion of the rod 32. The rod 32 is slidably received within a rod guide 40. Therefore, as the shaft 16 is rotated by the motor 18 to actuate the washing mechanism 14 within the tank housing 12, the cam 30 simultaneously drives the rod 32 in a reciprocating vertical motion. To control the reciprocating action of the rod 32 and maintain the vertical orientation thereof, the rod guide 40 is fixably mounted to the tank housing 12 by a brace 42** or other suitable structure.

As mentioned earlier, the cam 30 could be integrally disposed on the brush shaft 15. This would position the rod 30 closer to the washing mechanism 14. One benefit of positioning the rod 32 on the brush shaft 15 is that the motor 18 is detachable from the removable coupling 19. This permits easy removal of the motor 18 for easy servicing.

Referring again to the perspective view of FIG. 1, it can be seen by those skilled in the art that a plurality of mounting brackets 44 support and hold a golf ball holding box or receptacle 48. Further, it can be seen in that the holding box 48 comprises an agitator tray 50, which has a base 52 with an upstanding side wall 54 around the perimeter thereof. The base 52 comprises an inwardly extending flange about the perimeter of the tray 50. In one corner of the tray 50 where the side wall 54 is joined with the base 52, there is a tray exit chute 56 which allows for the passage of golf balls 57 to the ball entry hole 22 of the washing mechanism 14 so that the golf balls may be washed.

As further shown in FIG. 2, the base 52 overlappingly receives and supports an agitator plate 60, which may be hingedly connected along one portion of its perimeter by a hinge 62. Alternatively, the agitator plate 60 may be interconnected to the base 52 so that the plate is quasi free floating with respect to the base as by tack welding or bolting the plate 60 to the base 52 where the hinges 62 are shown. In other words, the plate 60 is permitted a limited amount of movement, while still being postionally retained in some manner to the base 52 along at least one edge thereof. The driving end 38 of the rod 32 is positioned immediately adjacent the plate 60 near an unretained edge thereof with the bearing surface **36*a* of the rod 32 being free riding upon the shaft 16 at the circumferential area having the cam 30. The driving end 38 reciprocatingly engages and deflects the plate 60 on each rotation of the motor shaft 16 as the cam 30 engages the bearing surface 36*a*. The nature and amount of deflection will, of course, depend upon the configuration of the cam 30 and its maximum extension from the motor shaft 16. Of course, multiple cams may be employed, if desired. In any event, the deflection of the unretained edge of the plate 60 must be sufficient to break up jams of balls at the exit chute 56. It will be appreciated that the holding box 48 could be configured such that the agitator plate 60 or an equivalent mechanism is slidably retained within the holding box. Ultimately, the purpose of the holding box 48 is to retain the golf balls 57 while still allowing the plate 60 or its equivalent to vibrate such that the golf balls are delivered to the washing mechanism 14**.

As can generally be seen in FIG. 1, the mounting brackets 44 will support the holding box 48 in an angular position so that gravity will direct the golf balls 57 towards the tray exit chute 56, and thus direct the balls into the washing mechanism 14 via the bail entry hole 22. Ideally, the golf balls 57 will be deposited into the holding box 48 and ultimately exit out the exit chute 24 of the washing mechanism 14 ready for re-use on the driving range. However, due to the natural tendency of spherical objects to mass together along with the mud and grass that accumulates on golf balls, plus any other foreign matter that may be picked up from off the driving range, such as golf tees, rocks, and paper waste, the golf balls 57 are likely to become jammed near the exit chute 56. Thus, the golf balls 57 in the holding box 48 must be shaken or agitated in some manner to dislodge the balls 57 from their fixed position. The prior art has recommended manually dislodging the balls, which defeats the purpose of an automated device or, in the alternative, affixing a second motor directly to the holding tray to dislodge the jammed golf balls, which is an inefficient use of apparatus and energy.

To solve this problem, the present invention provides a unique agitation means generally indicated by reference numeral 26, and which utilizes the motor 18 that drives the washing mechanism 14 to perform the dislodging function. In operation, and as shown by FIG. 1, as the motor 18 drives the brush shaft 15 and the motor shaft 16 to engage the washing mechanism 14, simultaneously, the cam 30 on the motor shaft 16 causes the rod 32 to reciprocate. This reciprocating action of the rod 32, sliding within the guide 40, is transferred to the agitator plate 60 via the drive end 38. As a result, the constant reciprocating action of the plate 60 will dislodge any golf balls 57 that become jammed from natural bridging or from foreign matter being included in the holding box 48.

To ensure smooth and continuous operation of the agitator plate 60, the plate will be joined to the base 52 of the agitator tray 50 by a hinge 62, bolt, or some other means along at least one edge thereof with the remainder of the plate being "free-floating" along a substantial portion of its perimeter. The rod 32 abuts the underside of the agitator plate 60 along the free-floating side thereof such that when the rod 32 pushes the plate 60 up, it will become ajar with respect to the base 52, thus dislodging any jammed golf balls 57. With the rod 32 engaging the plate 60 along the same free floating edge that extends to the tray exit chute 56, the plate 60 will become furthest ajar near the tray exit chute 56 to maximize the dislodging effect. Those skilled in the art will appreciate that the maximum distance that the plate 60 will deflect is less than the diameter of a golf ball. Otherwise, it is conceivable that a golf ball could become lodged underneath the plate 60, thereby impeding the reciprocating action of the rod 32 and thus the effectiveness of the device.

Another feature of the present invention is illustrated in FIG. 2. As can be seen, the free floating nature of the rod 32 within the guide 40 and upon either the brush shaft 15 or the motor shaft 16 allows the golf ball holding box 48 to be easily removed from the housing tank 12 so that any maintenance or repairs may be made thereon. This also permits the agitator plate 60 to be lifted away from the base 52 in such a manner that debris can be removed from underneath the plate; debris which would otherwise impede the reciprocating action of the plate. Additionally, the removable coupling 19 as seen in FIG. 1, allows for easy replacement of the motor 18.

Thus it can be seen that the objects of the invention have been satisfied by the structure presented above. The delivery of golf balls to a washing apparatus may be achieved by utilizing the same motor that powers the washing function. The means of ball delivery may be easily removed to assist in the cleaning and operation of the machine. The benefits of the invention will be readily apparent to those skilled in the art.

While one preferred embodiment of the invention has been presented and described in detail, it will be understood that the invention is not limited thereto or thereby. Accordingly, for an appreciation of the true scope and breadth of the invention, reference should be made to the following claims.

What is claimed is:

1. A golf ball washer, comprising:

a washing device;

a shaft connected to said washing device at a first end thereof;

a motor connected to a second end of said shaft for rotatably driving said shaft;

a golf ball holding box connected to said washing device, said holding box carrying an agitator plate for receiving a plurality of golf balls and feeding the golf balls to said washing device; and agitation means interposed between said shaft and said agitator plate for agitating said agitator plate to assure passage of the golf balls from the holding box to the washing device.

2. The golf ball washer according to claim 1, wherein said shaft has a cam thereon.

3. The golf ball washer according to claim 2, wherein said washing device has a ball entry hole and a ball exit chute.

4. The golf ball washer according to claim 3, wherein said golf ball holding box comprises an agitator tray for receiving said agitator plate.

5. The golf ball washer according to claim 4, wherein said agitator tray comprises a base with upstanding side walls around its perimeter said tray having a ball delivery chute feedingly connected to said ball entry hole.

6. The golf ball washer according to claim 5, wherein said agitator plate is hingedly mounted along at least one side to said base and substantially covers said agitator tray.

7. The golf ball washer according to claim 5, wherein said agitator plate is tack welded along one side to said base.

8. The golf ball washer according to claim 5, wherein said agitation means comprises a rod disposed between said shaft and said agitator plate and is slidably mounted within a rod guide.

9. The golf ball washer according to claim 8, wherein said rod has a cam end opposite a driving end, said cam end slidingly bearing on said cam, said driving end abutting said agitator plate, and wherein said motor actuates said cam, thereby reciprocating said rod, which in turn agitates said plate, thereby causing golf balls to proceed through said ball delivery chute.

10. A golf ball washer comprising:

a washing device having a ball entry hole and a ball exit chute;

a shaft with a cam thereon, said shaft connected to said washing device at a first end thereof;

a motor connected to a second end of said shaft for rotatably driving said shaft;

a golf ball holding box connected to said washing device agitator plate, said holding box receiving a plurality of golf balls and feeding the golf bails to said washing device; and agitation means interposed between said cam and said agitator plate for agitating said agitator plate to assure passage of the golf balls from the holding box to the washing device.

11. The golf ball washer according to claim 10, wherein said golf ball holding box comprises:

an agitator tray having a base with upstanding side wails around its perimeter, said agitator tray having a ball delivery chute feedingly connected to said ball entry hole wherein said agitator plate is received within said agitator tray and hingedly mounted at least one end to said base.

12. The golf ball washer according to claim 11, wherein said agitator plate is tack welded at one end to said base.

13. The golf ball washer according to claim 12, wherein said agitation means comprises a rod disposed between said shaft and said agitator plate and slidably mounted within a rod guide.

14. The golf ball washer according to claim 13, wherein said rod has a cam end opposite a driving end, said cam end slidingly bearing on said cam, said driving end abutting said agitator plate, and wherein said motor actuates said cam, thereby reciprocating said rod, which in turn agitates said plate, thereby causing golf balls to proceed through said ball delivery chute.

15. A golf ball washer comprising:

a washing device having a ball entry hole and a ball exit chute;

a shaft with a cam thereon, said shaft connected to said washing device at a first end thereof;

a motor connected to a second end of said shaft for rotatably driving said shaft;

a golf ball holding box connected to said washing device, said holding box receiving a plurality of golf balls and feeding the golf bails to said washing device;

an agitator tray having a base with upstanding side walls around its perimeter, said tray having a bail delivery chute feedingly connected to said ball entry hole;

an agitator plate received within said tray and hingedly mounted at one end to said base; and a plurality of brackets mountably supporting said tray upon said washing device; and agitation means interposed between said shaft and said holding box for agitating said holding box to assure passage of the golf balls from the holding box to the washing device.

16. The golf ball washer according to claim 15, wherein said agitator plate is tack welded at one end to said base and is otherwise free floating.

17. The golf ball washer according to claim 16, wherein said agitation means comprises:

a rod disposed between said shaft and said agitator plate and slidably mounted within a rod guide; and a brace mountably secured to said rod guide at one end and detachably secured at its opposite end to said washing device.

18. The golf ball washer according to claim 17, wherein said rod has a cam end opposite a driving end, said cam end being slidingly bearing on said cam, said driving end extending through said rod hole and abutting said agitator plate, and wherein said motor actuates said cam, thereby reciprocating said rod, which in turn agitates said plate, thereby causing golf balls to proceed through said ball delivery chute.

* * * * *